US011199064B2

(12) United States Patent
Cajiles et al.

(10) Patent No.: US 11,199,064 B2
(45) Date of Patent: Dec. 14, 2021

(54) INTEGRATED DEBRIS CATCHER AND PLUG SYSTEM

(71) Applicant: Halliburton Energy Services, Inc., Houston, TX (US)

(72) Inventors: Winfred Cajiles, Spring, TX (US); Paul Gregory James, Spring, TX (US); Julie Dawn Taylor, Inveririe (GB); Ronald George Taylor, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 161 days.

(21) Appl. No.: 16/549,308

(22) Filed: Aug. 23, 2019

(65) Prior Publication Data

US 2020/0131874 A1 Apr. 30, 2020

(51) Int. Cl.

| | |
|---|---|
| ***E21B 23/01*** | (2006.01) |
| ***E21B 33/12*** | (2006.01) |
| ***E21B 27/00*** | (2006.01) |

(52) U.S. Cl.

CPC ..... *E21B 23/01* (2013.01); *E21B 27/00* (2013.01); *E21B 33/12* (2013.01)

(58) Field of Classification Search

CPC ..... E21B 23/01; E21B 33/12; E21B 27/00; E21B 23/06; E21B 33/128

See application file for complete search history.

(56) References Cited

U.S. PATENT DOCUMENTS

| | | | | |
|---|---|---|---|---|
| 2,670,930 A * | 3/1954 | Farrar | ..... | E21B 27/00 175/308 |
| 2,927,644 A * | 3/1960 | Caldwell | ..... | E21B 27/00 166/99 |
| 2,928,469 A * | 3/1960 | Crowe | ..... | E21B 33/1294 166/126 |
| 2,993,539 A * | 7/1961 | Baker | ..... | E21B 37/00 166/99 |

(Continued)

FOREIGN PATENT DOCUMENTS

| | | |
|---|---|---|
| CA | 2910727 A1 | 10/2014 |
| CA | 2892880 C | 12/2015 |

(Continued)

OTHER PUBLICATIONS

International search report for PCT/US2018/058424, dated 2019.*
International written opinion for PCT/US2018/058424, dated 2019.*

*Primary Examiner* — Steven A Macdonald
(74) *Attorney, Agent, or Firm* — Scott Richardson; Parker Justiss, P.C.

(57) ABSTRACT

Embodiments of a debris catcher and a debris catching system are disclosed herein. In one embodiment, a debris catching system comprises a plug and a debris catcher, the debris catcher including at least a debris catching sleeve, a running tool coupled to the debris catching sleeve, the running tool including an uphole end and a downhole end, and further wherein the uphole end of the running tool is configured to slide to engage a downhole end of the debris catching sleeve and form a collection base of the debris (Continued)

catcher; and a coupling rod attached to the uphole end of the running tool, the coupling rod configured to engage a downhole setting device; wherein the plug is removably coupled with the downhole end of the running tool during downhole deployment of the debris catching system.

20 Claims, 5 Drawing Sheets

(56) References Cited

U.S. PATENT DOCUMENTS 3,227,216 A * 1/1966 Bumpers ..... E21B 31/06 166/66.5
3,561,529 A 2/1971 Owens
3,576,223 A 4/1971 Hasiba
3,633,670 A 1/1972 Brown et al.
3,651,867 A 3/1972 Baumstimler
3,814,180 A 6/1974 Oliver
3,907,047 A 9/1975 Thompson et al.
3,908,759 A 9/1975 Cagle et al.
3,987,847 A 10/1976 Craig
4,059,155 A 11/1977 Greer
4,084,636 A 4/1978 Burge
4,185,689 A 1/1980 Harris
4,189,012 A 2/1980 Garrett
4,217,966 A 8/1980 Garrett
4,226,285 A 10/1980 Moseley
4,254,983 A 3/1981 Harris
4,276,931 A 7/1981 Murray
4,390,064 A 6/1983 Enen et al.
4,423,783 A 1/1984 Haag
4,432,418 A 2/1984 Mayland
4,436,150 A 3/1984 Barker
4,491,178 A 1/1985 Terrell et al.
4,512,398 A 4/1985 Hazel
4,515,212 A 5/1985 Krugh
4,515,227 A 5/1985 Cerkovnik
4,532,989 A 8/1985 Barker
4,595,052 A 6/1986 Kristiansen
4,603,739 A 8/1986 Krugh
4,671,356 A 6/1987 Barker et al.
4,671,358 A 6/1987 Lindsey, Jr. et al.
4,674,573 A 6/1987 Bode
4,697,654 A 10/1987 Barr et al.
4,703,804 A 11/1987 Stokes et al.
4,773,478 A 9/1988 Streich
4,784,226 A 11/1988 Wyatt
4,791,988 A 12/1988 Trevillion
4,796,707 A 1/1989 Halbardier
4,828,026 A 5/1989 Nelson
4,869,325 A 9/1989 Halbardier
4,898,239 A 2/1990 Rosenthal
4,953,617 A 9/1990 Ross et al.
4,991,649 A 2/1991 Steinkamp
5,058,684 A 10/1991 Winslow et al.
5,310,001 A 5/1994 Burns, Sr. et al.
5,682,950 A 11/1997 Bjornstad
5,810,410 A 9/1998 Arterbury et al.
5,813,456 A 9/1998 Milner et al.
5,887,925 A 3/1999 Arterbury et al.
5,890,537 A * 4/1999 Lavaure ..... E21B 33/16 166/285
6,131,656 A 10/2000 Jani
6,152,219 A 11/2000 Vick, Jr. et al.
6,176,311 B1 1/2001 Ryan
6,189,617 B1 2/2001 Sorhus et al.
6,216,787 B1 4/2001 Ruttley
6,220,348 B1 4/2001 Serafin et al.
6,244,642 B1 6/2001 Serafin et al.
6,308,781 B2 10/2001 Ruttley
6,341,653 B1 1/2002 Firmaniuk et al.
6,354,386 B1 3/2002 Ruttley
6,357,539 B1 3/2002 Ruttley
6,453,996 B1 9/2002 Carmichael et al.
6,460,617 B1 10/2002 Allen
6,666,275 B2 12/2003 Neal et al.
6,732,799 B2 5/2004 Challacombe
6,951,251 B2 10/2005 Penisson
7,036,602 B2 5/2006 Turley et al.
7,096,950 B2 8/2006 Howlett et al.
7,188,675 B2 3/2007 Reynolds
7,290,617 B2 11/2007 Popilian et al.
7,389,823 B2 6/2008 Turley et al.
7,472,745 B2 1/2009 Lynde et al.
7,497,260 B2 3/2009 Telfer
7,559,364 B2 7/2009 Bullard
7,654,334 B2 2/2010 Manson
7,694,755 B2 4/2010 Marvel et al.
7,753,113 B1 * 7/2010 Penisson ..... E21B 27/00 166/99
7,753,124 B1 7/2010 Penisson
7,757,756 B2 7/2010 Bullard
8,002,030 B2 8/2011 Turley et al.
8,100,257 B1 1/2012 Zimmer
8,127,851 B2 3/2012 Misselbrook
8,162,064 B1 * 4/2012 Penisson ..... E21B 27/00 166/368
8,230,991 B1 7/2012 Zimmer
8,240,373 B1 8/2012 Britton et al.
8,316,931 B2 11/2012 Rondeau et al.
8,327,930 B2 12/2012 Rondeau
8,327,937 B2 12/2012 Giem et al.
8,453,724 B2 6/2013 Zhou
8,469,120 B2 6/2013 Entchev et al.
8,505,623 B2 8/2013 Williamson
8,540,028 B1 9/2013 Penisson
8,579,024 B2 11/2013 Mailand et al.
8,622,131 B2 1/2014 Giem et al.
8,714,260 B2 5/2014 Knobloch et al.
8,727,008 B2 5/2014 Krpec
8,839,869 B2 9/2014 Porter et al.
8,869,904 B2 10/2014 Jani
8,887,807 B2 11/2014 Gambier et al.
8,960,283 B2 2/2015 Rondeau et al.
8,978,752 B2 3/2015 Dobson et al.
9,121,253 B2 9/2015 Gregory
9,279,307 B2 3/2016 Williamson
9,359,871 B2 * 6/2016 White ..... E21B 34/14
9,650,861 B2 5/2017 Pederson et al.
9,784,060 B2 10/2017 Hiorth et al.
9,810,034 B2 11/2017 Pray et al.
9,816,342 B2 11/2017 Pederson et al.
2005/0072571 A1 * 4/2005 Penisson ..... E21B 27/00 166/311
2007/0131426 A1 6/2007 Telfer
2007/0272404 A1 11/2007 Lynde et al.
2007/0272412 A1 11/2007 Telfer
2008/0066902 A1 3/2008 Bullard
2008/0173453 A1 7/2008 Misselbrook
2008/0179065 A1 7/2008 Vincent et al.
2008/0314583 A1 12/2008 Xu
2009/0000792 A1 1/2009 Turley et al.
2009/0044957 A1 2/2009 Clayton et al.
2009/0095537 A1 4/2009 Marvel et al.
2009/0173489 A1 7/2009 Bullard
2009/0321085 A1 12/2009 Rodgers
2010/0126771 A1 5/2010 Entchev et al.
2010/0155052 A1 6/2010 Manson
2010/0181064 A1 7/2010 Knobloch et al.
2010/0236782 A1 9/2010 Bruegger
2010/0239404 A1 9/2010 Blanchard et al.
2010/0276159 A1 11/2010 Mailan et al.
2011/0017475 A1 1/2011 Cresswell et al.
2011/0036564 A1 2/2011 Williamson
2011/0048743 A1 3/2011 Stafford
2011/0067865 A1 3/2011 Rondeau
2011/0067866 A1 3/2011 Rondeau et al.
2011/0146986 A1 6/2011 Giem et al.
2011/0232899 A1 9/2011 Porter et al.
2011/0253376 A1 10/2011 Krpec
2012/0024522 A1 2/2012 Dobson et al.
2012/0043073 A1 2/2012 Bishop et al.
2012/0067596 A1 3/2012 Turley et al.

(56) References Cited

U.S. PATENT DOCUMENTS

2012/0073827 A1 3/2012 Kenyon et al.
2012/0118571 A1 5/2012 Zhou
2012/0125631 A1 5/2012 Entchev et al.
2012/0160482 A1 6/2012 Rondeau et al.
2012/0168161 A1 7/2012 Bowersock et al.
2013/0008671 A1 1/2013 Booth
2013/0014948 A1 1/2013 Gambier et al.
2013/0014958 A1 1/2013 Jani
2013/0140025 A1 6/2013 Giem et al.
2013/0153245 A1 6/2013 Knobloch
2013/0228327 A1* 9/2013 White ..... E21B 27/005 166/227
2013/0292119 A1 11/2013 Hilliard et al.
2013/0306327 A1 11/2013 Williamson
2014/0027395 A1 1/2014 Benoit et al.
2014/0096949 A1 4/2014 Mclaren
2014/0166317 A1 6/2014 Gregory
2014/0196913 A1 7/2014 Pedersen et al.
2014/0216761 A1 8/2014 Trinh
2014/0345874 A1 11/2014 Campbell
2014/0367083 A1 12/2014 McClinton et al.
2015/0060046 A1 3/2015 Tessari et al.
2015/0083421 A1 3/2015 Sommers
2015/0090292 A1 4/2015 Depatie
2015/0122511 A1 5/2015 Pedersen
2015/0136395 A1 5/2015 Turley et al.
2015/0159463 A1 6/2015 Frazier
2015/0211338 A1 7/2015 Holtby et al.
2015/0275630 A1 10/2015 Turner
2015/0300118 A1 10/2015 Hiorth et al.
2016/0024876 A1 1/2016 Ward et al.
2016/0032682 A1 2/2016 Sommers
2016/0040492 A1 2/2016 Vinson et al.
2016/0053566 A1 2/2016 Winkler
2016/0060989 A1* 3/2016 Pedersen ..... E21B 33/134 166/301
2016/0138363 A1 5/2016 Sommers
2016/0160596 A1 6/2016 Malafey et al.
2016/0168935 A1 6/2016 Pray et al.
2016/0168938 A1 6/2016 Pray et al.
2016/0177646 A1 6/2016 Penisson et al.
2016/0298423 A1 10/2016 Getzlaf et al.
2016/0305219 A1 10/2016 Holloway et al.
2016/0312582 A1 10/2016 Ali et al.
2017/0037693 A1 2/2017 Cottrell et al.
2017/0067313 A1 3/2017 Connell et al.
2017/0130554 A1 5/2017 Jones et al.
2017/0145782 A1 5/2017 Ferg
2017/0234092 A1 8/2017 Howard et al.
2017/0241239 A1 8/2017 Connell et al.
2017/0314361 A1 11/2017 Rosenthal
2017/0314364 A1 11/2017 Getzlaf et al.
2017/0342798 A1 11/2017 Wutherich

FOREIGN PATENT DOCUMENTS

WO 2014161073 A1 10/2014
WO 2014175750 A1 10/2014

* cited by examiner

INTEGRATED DEBRIS CATCHER AND PLUG SYSTEM

CROSS-REFERENCE TO RELATED APPLICATION

This application claims priority to International Application Serial No. PCT/US2018/058424, filed on Oct. 31, 2018, and entitled "INTEGRATED DEBRIS CATCHER AND PLUG SYSTEM," is commonly assigned with this application and incorporated herein by reference in its entirety.

BACKGROUND

In the oil and gas industry, once casing is placed into a wellbore, certain portions of the wellbore may need to be isolated. A plug, such as, e.g., a bridge plug, may be placed down into the wellbore to isolate the desired portion. However, operations that may continue in the wellbore uphole of the plug may produce significant amounts of debris and junk. Debris catchers, such as junk baskets, are often placed above the plug to catch the junk and debris such that when the plug needs to be removed, the debris may be removed first, enabling easier retrieval of the plug.

Traditionally, the plug is set in one downhole trip using a setting tool run from the surface. The setting tool must be brought back to the surface and the junk basket attached, which is then set in an additional downhole trip. Each downhole trip costs time and, likewise, money. What is needed is a debris catcher and plug system that does not experience the drawbacks of existing debris catchers and plug systems.

BRIEF DESCRIPTION

Reference is now made to the following descriptions taken in conjunction with the accompanying drawings, in which.

DETAILED DESCRIPTION

Figure 1:
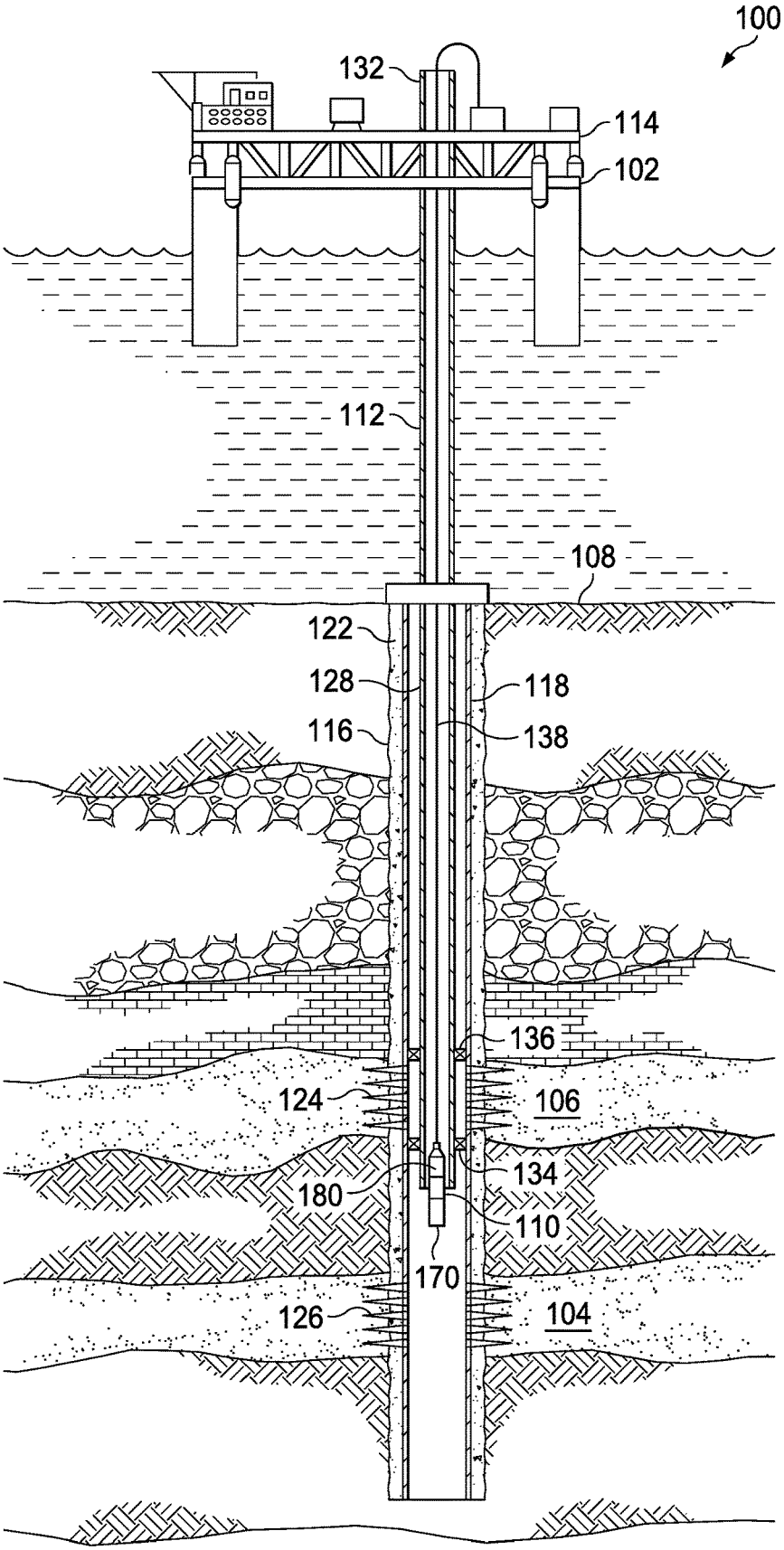
FIG. 1 is a schematic illustration of an offshore oil and gas platform during the installation of an integrated debris catcher and plug system according to principles of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Previous embodiments of plugs and debris catchers have required multiple downhole trips—a trip to set the plug and at least one additional trip to set the debris catcher. Some embodiments have deployed a system wherein a downhole end of the debris catcher has an opening, such as a flap, flapper, or similar type opening, such that a downhole power unit extends through the downhole end of the debris catcher to engage and set the plug. What is proposed is a debris catcher and plug system that may be installed in a single downhole trip wherein the base of the debris catcher is non-opening and remains securely closed and in place once the plug and debris catcher have been set into the wellbore.

Referring initially to FIG. 1, there is shown a plug 170 and debris catcher 110 being installed from an offshore oil and gas platform that is schematically illustrated and generally designated 100. A semi-submersible platform 102 is centered over submerged oil and gas formations 104, 106 located below sea floor 108. A subsea conductor 112 extends from deck 114 of platform 102 to sea floor 108. A wellbore 116 extends from sea floor 108 and traverse formations 104, 106. Wellbore 116 includes a casing 118 that is supported therein by cement 122. Casing 118 has two sets of perforations 124, 126 in the intervals proximate formations 104, 106.

A tubing string 128 extends from wellhead 132 to a location below formation 106 but above formation 104 and provides a conduit for production fluids to travel to the surface. A pair of packers 134, 136 provides a fluid seal between tubing string 128 and casing 118 and directs the flow of production fluids from formation 106 to the interior of tubing string 128 through, for example, a slotted liner. Disposed within tubing string 128 is a wireline 138 used to convey a tool system including at least a downhole setting device, such as downhole power unit (DPU) 180, debris catcher 110, and plug 170, such as e.g., a bridge plug. Even though downhole power unit 180, debris catcher 110, and plug 170 are depicted as being deployed on a wireline, it is to be understood by those skilled in the art that downhole power unit 180, debris catcher 110, and plug 170 could be deployed on other types of conveyances and downhole setting devices, including, but not limited to a slickline, coiled tubing, jointed tubing, a downhole robot or the like, without departing from the principles of the present disclosure.

As will be described in more detail below, a particular implementation of downhole power unit 180 includes an elongated housing, a motor disposed in the housing and a sleeve connected to a rotor of the motor. The sleeve is a rotational member that rotates with the rotor. A moveable member such as the above-mentioned moveable shaft is received within the threaded interior of the sleeve. Operation of the motor rotates the sleeve which causes the moveable shaft to move longitudinally. Accordingly, when downhole power unit 180 is operably coupled with debris catcher 110 and plug 170 and the moveable member is activated, longitudinal movement is imparted to the debris catcher 110 and plug 170.

Even though FIG. 1 depicts a vertical well, it should be understood by those skilled in the art that the debris catcher 110 and plug 170 of the present disclosure are equally well-suited for use in deviated wells, inclined wells, horizontal wells, multilateral wells and the like. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Likewise, even though FIG. 1 depicts an offshore operation, it should be understood by those skilled in the art that the through tubing bridge plug and junk basket of the present disclosure is equally well-suited for use in onshore operations. Also, even though FIG. 1 depicts a cased wellbore, it should be understood by those skilled in the art that the through tubing bridge plug and junk basket of the present disclosure is equally well-suited for use in open hole operations.

Figure 2A:
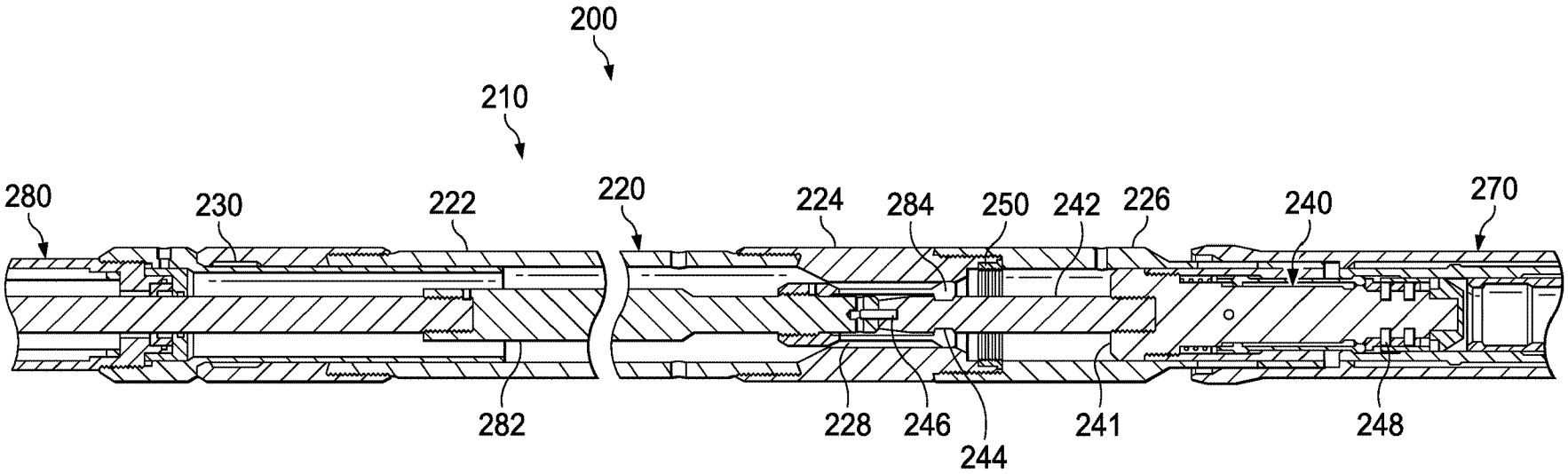
FIG. 2A is a section view illustrating one stage of deployment of an integrated debris catcher and plug system according to principles of the disclosure running inhole during downhole deployment.
Figure 2B:
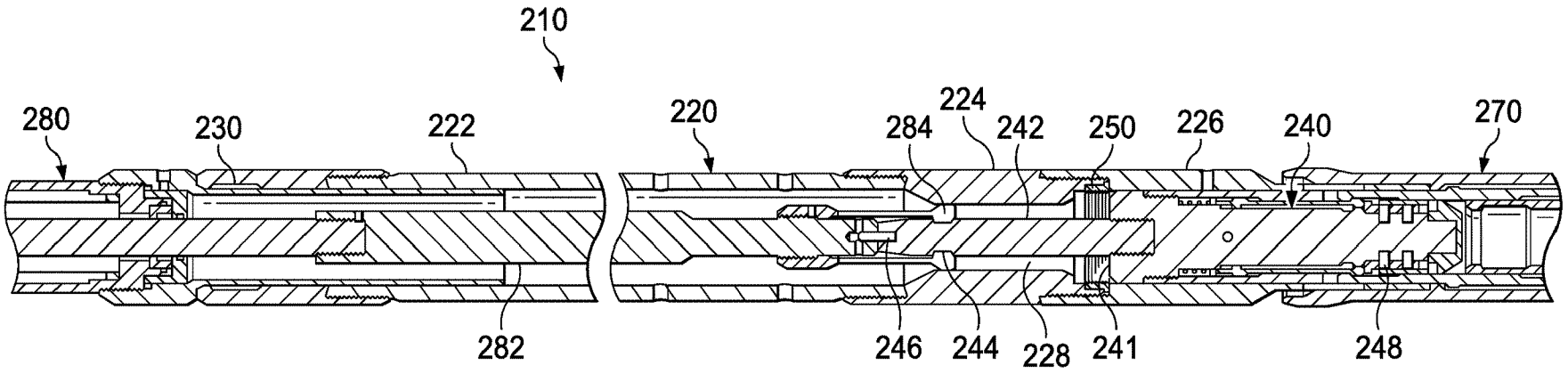
FIG. 2B is a section view illustrating another stage of downhole deployment of the integrated debris catcher and plug system according to principles of the disclosure as the plug is being set in the wellbore.

Referring now to FIG. 2A, there is shown one embodiment of an integrated debris catcher and plug deployment system 200 (hereinafter deployment system 200) for deploying a debris catcher 210 engaged with a plug 270 using a downhole setting device 280. In one embodiment, the plug 270 and debris catcher 210 may be deployed in a single downhole trip using downhole setting device 280, which in some embodiments may be a downhole power unit. In the example embodiment, the debris catcher 210 includes a debris catching sleeve 220. The debris catching sleeve 220, among other features, may include an extension sleeve 222, an upper running sleeve 224, and a lower running sleeve 226. While only a single extension sleeve 222 has been illustrated, those skilled in the art understand that multiple extension sleeves 222 may be used (e.g., coupled together in one embodiment) to accommodate various different volumes of debris. The lower running sleeve 226 extends downhole and sits within an opening in plug 270. The debris catcher 210 further includes a running tool 240 positioned within the lower running sleeve 226 that engages with the plug 270. In one embodiment (e.g., as shown in FIG. 2D), the uphole end of the running tool 240 engages with a locking ring within the upper running sleeve 224 to form a collection base of the debris catcher 210.

Figure 2C:
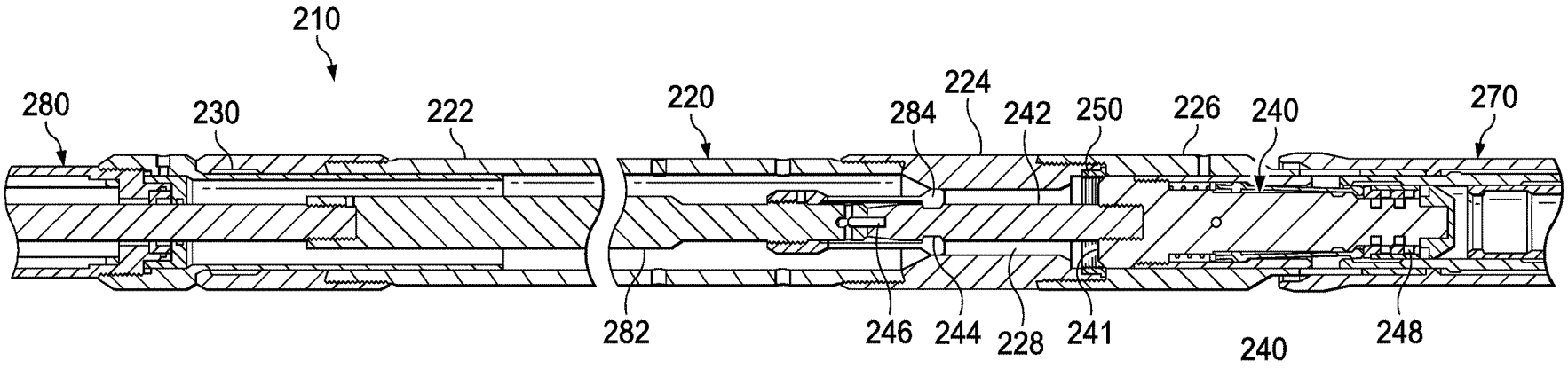
FIG. 2C is a section view illustrating yet another stage of downhole deployment of the integrated debris catcher and plug system according to principles of the disclosure as force is applied uphole to disengage the debris catcher from the plug.
Figure 2D:
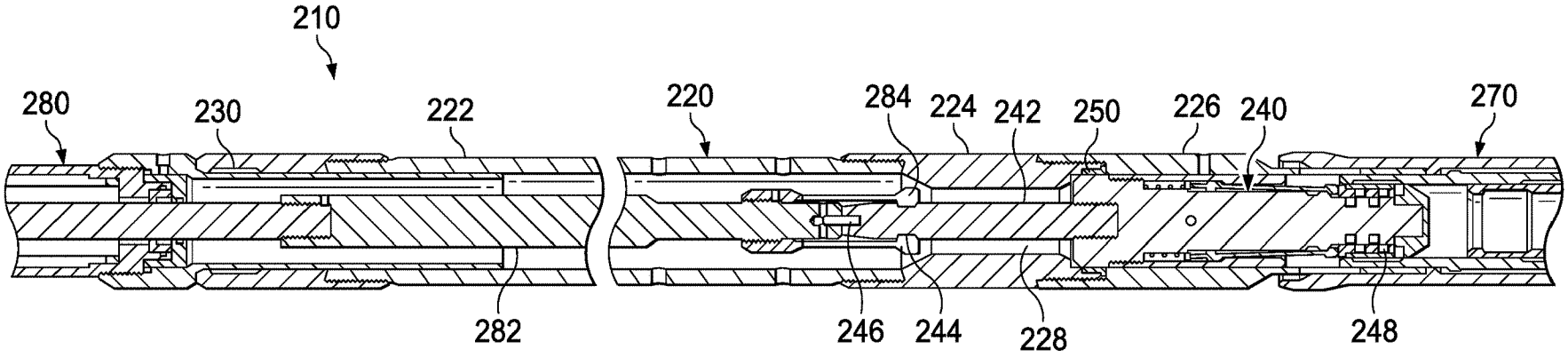
FIG. 2D is a section view illustrating still another stage of downhole deployment of the integrated debris catcher and plug system according to principles of the disclosure as a downhole setting device begins to disengage from the debris catcher.

The running tool 240 includes one or more shear features 248 configured to set plug 270, but shear and release the running tool 240 from the plug 270 (e.g. as shown in FIG. 2C) when the plug is set and the running tool 240 is being drawn uphole. The running tool 240 is coupled with an extension rod 282 of downhole setting device 280 by a coupling rod 242. An alignment pin 246 is positioned near and extends from an uphole end of coupling rod 242. The alignment pin 246 aligns the coupling rod 242 with a downhole end of the extension rod 282.

A collet 284 is positioned axially about and extends from the downhole end of the extension rod 282. The downhole end of the collet 284, in the illustrated embodiment, engages an axial groove 244 of the coupling rod 242. During the downhole deployment, as shown in FIG. 2A, the collet is positioned within a reduced diameter bore 228 of the upper running sleeve 224. In this configuration, the reduced diameter bore 228 keeps the collet 284 from disengaging from the axial groove 244. Positioned axially about the coupling rod 242 is a locking ring 250. In one embodiment, the locking ring 250 is configured to engage the uphole end of the running tool 240. In one embodiment, the running tool 240 includes, at its uphole end, no-go shoulder 241 which prevent the running tool 240 from moving uphole of the upper running sleeve 224, for example as is shown in FIG. 2D.

In the illustrated embodiment, an uphole end of the extension sleeve 222 includes a catch profile 230. The catch profile 230 may engage with a retrieval tool for future retrieval of the debris catcher 210. In the illustrated embodiment of FIG. 2A, the catch profile 230 is not in use.

Referring now to FIG. 2B, there is shown a section view of the deployment system 200 as the plug 270 is being set in the wellbore to seal off a downhole portion of the wellbore. Downhole force is applied by the downhole setting device 280 to set the plug 270. Tensile force, in this embodiment, is applied until the locking ring 250 meets with and engages the running tool 240. At this stage of the deployment, the plug 270 is set within the wellbore, and at the same time the debris catcher remains engaged with the plug 270.

Referring now to FIG. 2C, there is shown a section view of the deployment system 200 as tensile force is applied to begin retraction of the downhole setting device 280 from the plug 270. As the running tool 240 is drawn uphole, the uphole force causes the one or more shear features 248 to shear thereby disengaging the running tool 240, and as such, the debris catcher 200, from the plug 270. In one embodiment, the one or more shear features 248 include shear pins which removably couple plug 270 with the running tool 240. As further tensile force is applied, the running tool 240 is drawn uphole and into locking ring 250. At this stage of downhole deployment, the collet 284 remains engaged in the reduced diameter bore 228 and seated in the axial groove 244. Accordingly, the extension rod 282 of the downhole setting device 280 remains engaged with the coupling rod 242.

Referring now to FIG. 2D, there is shown a section view of the deployment system 200 as the setting device 280 begins to disengage from the debris catcher 210. As additional uphole force is applied to retract the downhole setting device 280, the coupling rod 242 is further drawn uphole, which also draws the running tool 240 uphole and further engaging the locking ring 250. When the locking ring 250 is fully engaged with the running tool 240, the running tool becomes the base of the debris catcher 210. As tensile force is continuously applied, the collet 284 is drawn out of the reduced diameter bore, which allows the collect to extend radially outward and disengage from the axial groove 244. At this point, the extension rod 282 of the downhole setting device 280 may disengage from the coupling rod 242.

Figure 2E:
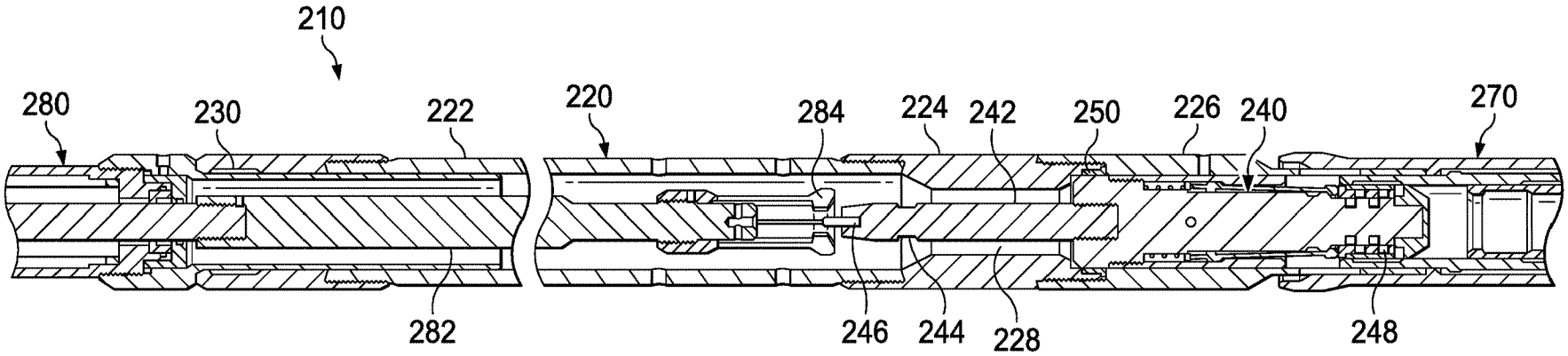
FIG. 2E is a section view illustrating another stage of downhole deployment of the integrated debris catcher and plug system according to principles of the disclosure showing the downhole setting device disengaged from the debris catcher and being pulled uphole.

FIG. 2E is a section view illustrating the downhole setting device 280 substantially disengaged from the debris catcher 210. As tensile force is continuously applied, the collet 284 disengages from the reduced diameter bore 228 such that downhole setting device 280 is substantially disconnected from the debris catcher 210 and may be drawn uphole for removal from the wellbore. The debris catcher 210 is held atop the plug 270 by gravity to catch any debris caused by uphole activity. As is illustrated, the uphole end of the running tool 240 engages with a locking ring within the upper running sleeve 224 to form a collection base of the debris catcher 210.

Figure 2F:
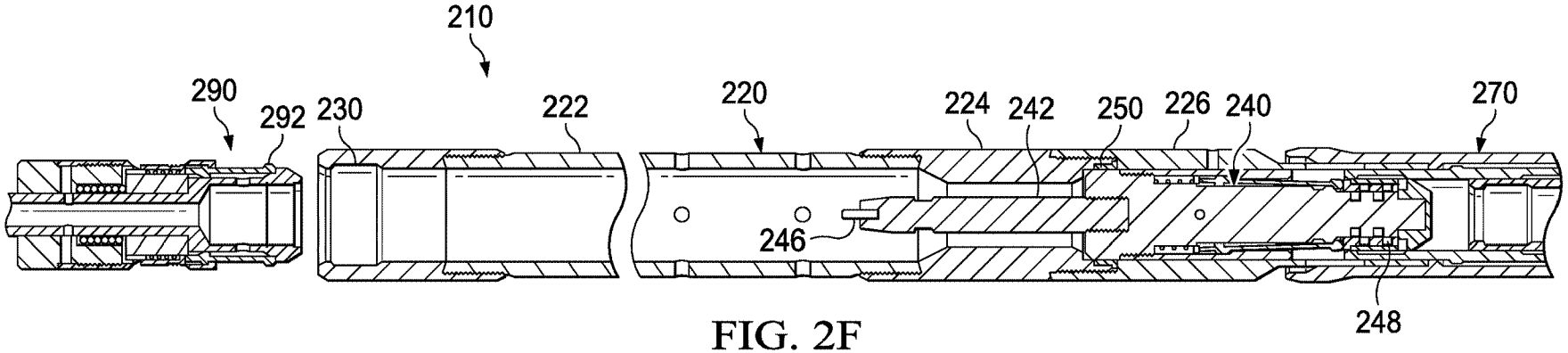
FIG. 2F is a section view illustrating an initial stage of retrieval of the debris catcher of the integrated debris catcher and plug system according to principles of the disclosure.

FIG. 2F is a section view illustrating a first stage of retrieval of the debris catcher 210 from the wellbore. Such a configuration would exist after the debris catcher 210 has served its purpose, and thus is at least partially or substantially filled with debris, and must be withdrawn from the wellbore. FIG. 2F illustrates a retrieval tool 290 approaching the debris catcher 210. The retrieval tool 290, in the embodiment shown, includes an engagement member 292. The engagement member 292, as shown, is configured to engage the catch profile 230 in the inner diameter of the uphole end of the debris catcher 210.

Figure 2G:
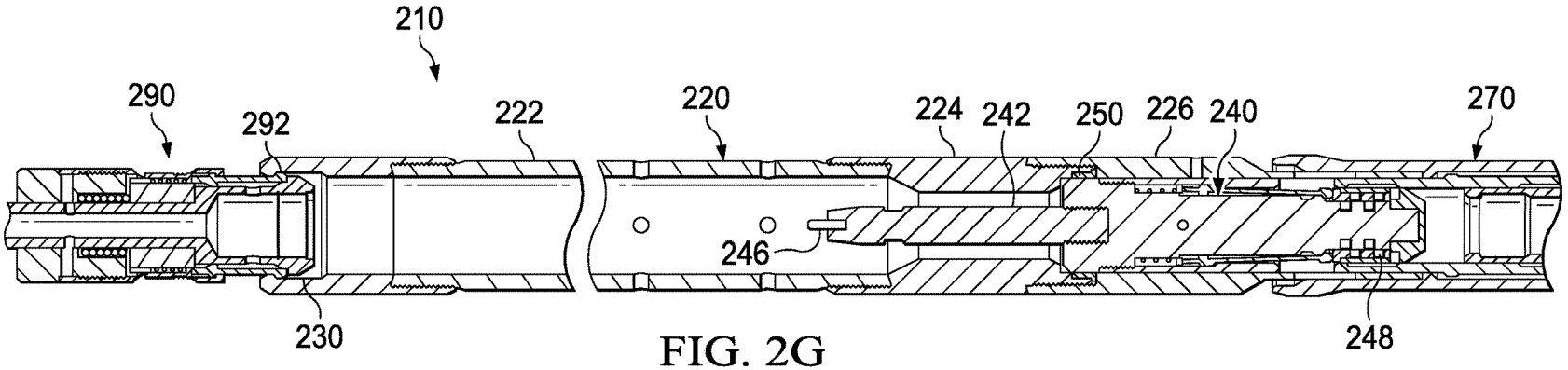
FIG. 2G is a section view illustrating a next stage of retrieval of the debris catcher of the integrated debris catcher and plug system according to principles of the disclosure.

FIG. 2G is a section view illustrating retrieval of the debris catcher 210 of the integrated debris catcher and plug system according to principles of the disclosure. The retrieval tool 286, and more specifically the engagement member 292, is shown engaged in the catch profile 230 of the debris catcher 210. Once the retrieval tool is fully engaged in the catch profile 230, uphole force may be applied to the downhole setting device 280 to retrieve the debris catcher 210 for removal from the wellbore. At this stage, the plug 270 would remain within the wellbore, and may be retrieved by conventional methods.

Various aspects of the disclosure can be claimed including the apparatuses, systems, and methods disclosed herein. Aspects disclosed herein include:

A. A debris catcher for use within a wellbore, comprising: a debris catching sleeve; a running tool coupled to the debris catching sleeve, the running tool including an uphole end and a downhole end, and further wherein the uphole end of the running tool is configured to slide to engage a downhole end of the debris catching sleeve and form a collection base of the debris catcher; and a coupling rod attached to the uphole end of the running tool, the coupling rod configured to engage a downhole setting device.

B. A debris catching system for use within a wellbore, comprising: a plug; and a debris catcher, the debris catcher comprising: a debris catching sleeve; a running tool coupled to the debris catching sleeve, the running tool including an uphole end and a downhole end, and further wherein the uphole end of the running tool is configured to slide to engage a downhole end of the debris catching sleeve and form a collection base of the debris catcher; and a coupling rod attached to the uphole end of the running tool, the coupling rod configured to engage a downhole setting device; wherein the plug is removably coupled with the downhole end of the running tool during downhole deployment of the debris catching system.

C. A method of setting a debris catcher into a wellbore, the method comprising: providing an integrated debris catcher and plug deployment system, the integrated debris catcher and plug deployment system including: a debris catcher, the debris catcher including: a debris catching sleeve, the debris catching sleeve including an extension sleeve, an upper running sleeve and a lower running sleeve, wherein the upper running sleeve includes a reduced diameter bore configured to engage a collet of a downhole setting device; a running tool coupled to the debris catching sleeve, the running tool including an uphole end and a downhole end, and further wherein the uphole end of the running tool is configured to slide to engage a downhole end of the debris catching sleeve and form a collection base of the debris catcher; and a coupling rod attached to the uphole end of the running tool, the coupling rod configured to engage the downhole setting device; a plug removably coupled with the downhole end of the running tool by one or more shear features configured to set the plug, and shear and release the running tool from the plug when being drawn uphole; deploying the integrated debris catcher and plug deployment system downhole using the downhole setting device.

Each of aspects A, B, and C can have one or more of the following additional elements in combination:

Element 1: wherein the debris catching sleeve includes an extension sleeve, an upper running sleeve and a lower running sleeve, and further wherein the upper running sleeve includes a reduced diameter bore configured to engage a collet of the downhole setting device;

Element 2: wherein the coupling rod further includes an axial groove for receiving the collet when the collet is located in the reduce diameter bore;

Element 3: wherein a downhole end of the upper running sleeve includes a locking ring, wherein the locking ring is configured to engage the uphole end of the running tool;

Element 4: wherein the running tool is positioned within the lower running sleeve, and further wherein a downhole end of the lower running sleeve is configured to insert into an uphole end of the plug;

Element 5: wherein the running tool is positioned within the lower running sleeve, and further wherein a downhole end of the lower running sleeve is configured to insert into an uphole end of the plug;

Element 6: wherein the running tool includes one or more shear features configured to set a plug, and shear and release the running tool from the plug when being drawn uphole;

Element 7: wherein the coupling rod includes an alignment pin configured to align with an opening in a downhole end of an extension rod of the downhole setting device;

Element 8: wherein an uphole end of the debris catching sleeve includes a catch profile, the catch profile configured to engage an associated engagement member of a retrieval tool; and Element 9: wherein deploying the integrated debris catcher and plug deployment system downhole includes: applying a downhole force to deploy the debris catcher downhole until the plug engages a selected portion of the wellbore and the locking ring engages the uphole end of the running tool; applying an uphole force to the downhole setting device, wherein the uphole force shears the running tool from the plug and draws the running tool uphole; and maintaining the uphole force on the downhole setting device until the collet disengages from the reduced diameter bore, disengaging the downhole setting device from the running tool and drawing the downhole setting device uphole.

Those skilled in the art to which this application relates will appreciate that other and further additions, deletions, substitutions and modifications may be made to the described embodiments.

What is claimed is:

1. A debris catcher for use within a wellbore, comprising:

a debris catching sleeve;

a running tool coupled to the debris catching sleeve, the running tool including an uphole end and a downhole end, and further wherein the uphole end of the running tool is configured to slide to engage a downhole end of the debris catching sleeve and form a collection base of the debris catcher, and further wherein a downhole end of the running tool is configured to insert into and engage with a plug; and a coupling rod attached to the uphole end of the running tool, the coupling rod configured to engage a downhole setting device.

2. The debris catcher as recited in claim 1, wherein the debris catching sleeve includes an extension sleeve, an upper running sleeve and a lower running sleeve, and further wherein the upper running sleeve includes a reduced diameter bore configured to engage a collet of the downhole setting device.

3. The debris catcher as recited in claim 2, wherein the coupling rod further includes an axial groove for receiving the collet when the collet is located in the reduce diameter bore.

4. The debris catcher as recited in claim 2, wherein a downhole end of the upper running sleeve includes a locking ring, wherein the locking ring is configured to engage the uphole end of the running tool.

5. The debris catcher as recited in claim 2, wherein the running tool is positioned within the lower running sleeve, and further wherein a downhole end of the lower running sleeve is configured to insert into an uphole end of the plug.

6. The debris catcher as recited in claim 1, wherein the running tool includes one or more shear features configured to set a plug, and shear and release the running tool from the plug when being drawn uphole.

7. The debris catcher as recited in claim 1, wherein the coupling rod includes an alignment pin configured to align with an opening in a downhole end of an extension rod of the downhole setting device.

8. The debris catcher as recited in claim 1, wherein an uphole end of the debris catching sleeve includes a catch profile, the catch profile configured to engage an associated engagement member of a retrieval tool.

9. A debris catching system for use within a wellbore, comprising:

a plug; and a debris catcher, the debris catcher comprising:

a debris catching sleeve;

a running tool coupled to the debris catching sleeve, the running tool including an uphole end and a downhole end, and further wherein the uphole end of the running tool is configured to slide to engage a downhole end of the debris catching sleeve and form a collection base of the debris catcher; and a coupling rod attached to the uphole end of the running tool, the coupling rod configured to engage a downhole setting device;

wherein the plug is removably coupled with the downhole end of the running tool during downhole deployment of the debris catching system.

10. The debris catching system as recited in claim 9, wherein the debris catching sleeve includes an extension sleeve, an upper running sleeve and a lower running sleeve, and further wherein the upper running sleeve includes a reduced diameter bore configured to engage a collet of the downhole setting device.

11. The debris catching system as recited in claim 10, wherein the coupling rod further includes an axial groove for receiving the collet when the collet is located in the reduce diameter bore.

12. The debris catching system as recited in claim 10, wherein a downhole end of the upper running sleeve includes a locking ring, wherein the locking ring is configured to engage the uphole end of the running tool.

13. The debris catching system as recited in claim 10, wherein the running tool is positioned within the lower running sleeve, and further wherein a downhole end of the lower running sleeve is configured to engage an uphole end of the plug.

14. The debris catching system as recited in claim 10, wherein an uphole end of the debris catching sleeve includes a catch profile, the catch profile configured to engage an associated feature of a retrieval tool.

15. The debris catching system as recited in claim 9, wherein the plug is removably coupled with the downhole end of the running tool by one or more shear features configured to set the plug, and then shear and release the running tool from the plug when being drawn uphole.

16. The debris catching system as recited in claim 9, wherein the coupling rod includes an alignment pin configured to align with an opening in a downhole end of an extension rod of the downhole setting device.

17. The debris catching system as recited in claim 9, wherein the plug is a bridge plug.

18. A method of setting a debris catcher into a wellbore, the method comprising:

providing an integrated debris catcher and plug deployment system, the integrated debris catcher and plug deployment system including:

a debris catcher, the debris catcher including:

a debris catching sleeve, the debris catching sleeve including an extension sleeve, an upper running sleeve and a lower running sleeve, wherein the upper running sleeve includes a reduced diameter bore configured to engage a collet of a downhole setting device;

a running tool coupled to the debris catching sleeve, the running tool including an uphole end and a downhole end, and further wherein the uphole end of the running tool is configured to slide to engage a downhole end of the debris catching sleeve and form a collection base of the debris catcher; and a coupling rod attached to the uphole end of the running tool, the coupling rod configured to engage the downhole setting device;

a plug removably coupled with the downhole end of the running tool by one or more shear features configured to set the plug, and shear and release the running tool from the plug when being drawn uphole; and deploying the integrated debris catcher and plug deployment system downhole using the downhole setting device.

19. The method as recited in claim 18, wherein deploying the integrated debris catcher and plug deployment system downhole includes:

applying a downhole force to deploy the debris catcher downhole until the plug engages a selected portion of the wellbore and the locking ring engages the uphole end of the running tool;

applying an uphole force to the downhole setting device, wherein the uphole force shears the running tool from the plug and draws the running tool uphole; and maintaining the uphole force on the downhole setting device until the collet disengages from the reduced diameter bore, disengaging the downhole setting device from the running tool and drawing the downhole setting device uphole.

20. The method as recited in claim 18, wherein the coupling rod further includes an axial groove for receiving the collet when the collet is located in the reduce diameter bore.

* * * * *